US007432231B2

(12) United States Patent
Gibbons

(10) Patent No.: US 7,432,231 B2
(45) Date of Patent: Oct. 7, 2008

(54) GUN OIL COMPOSITION

(76) Inventor: Paul J. Gibbons, Box 272, Boynton Beach, FL (US) 33425

( * ) Notice: Subject to any disclaimer, the term of this patent is extended or adjusted under 35 U.S.C. 154(b) by 463 days.

(21) Appl. No.: 11/065,756

(22) Filed: Feb. 25, 2005

(65) Prior Publication Data

US 2006/0194701 A1 Aug. 31, 2006

(51) Int. Cl.
*C10M 169/04* (2006.01)
*C10M 137/10* (2006.01)
*C10M 145/14* (2006.01)

(52) U.S. Cl. ..... 508/208; 508/371; 508/469; 508/110

(58) Field of Classification Search ..... 508/208, 508/110, 371, 469
See application file for complete search history.

(56) References Cited

U.S. PATENT DOCUMENTS 3,849,723 A * 11/1974 Allen ..... 324/446
4,113,633 A * 9/1978 Gibbons ..... 508/214

OTHER PUBLICATIONS

ROCOL Penetrating Spray, Safety Data Sheet dated Jun. 30, 2003/, retrieved from <http://www.farnell.com/datasheets/49196.pdf> on Jul. 26, 2007.*
Green Tree Chemical, 6330CG, Generation 200 Penetrating Oil (Formula 318) MSDS dated Oct. 18, 2001, retrieved from <http://www2.hazard.com/msds/f2/clp/clptm.html> on Jul. 25, 2007.*
Biral PO-Penetrating Oil, safety data, dated Jun. 15, 2000, retrieved from <http://www.biral.org/php/showdabl?lang=de&type=datenblatt&doc=PO-Aerosol%20S.html> on Jul. 26, 2007.*

* cited by examiner

*Primary Examiner*—Glenn Caldarola
*Assistant Examiner*—Jim Goloboy
(74) *Attorney, Agent, or Firm*—Andrew Wilford; Jonathan Myers

(57) ABSTRACT

A gun oil composition consisting essentially of:
2.0 to 15% by weight of isopropanol;
20 to 60% by weight of heptane or a petroleum distillate;
3 to 20% by weight of a mixture of viscosity modifiers, antioxidants and reducing agents including benzyl acetate, t-dibutyl-p-cresol, at least one alkyl succinic acid, at least one zinc alkyl thiophosphate, polymethacrylate, and methyl silicone polymer, wherein the alkyl is $C_1$ to $C_6$ alkyl; and
the balance, lube oil bright stock to 100% by weight.

2 Claims, No Drawings

GUN OIL COMPOSITION

FIELD OF THE INVENTION

The present invention relates to an improved gun oil composition and a method of treating a gun and particularly the firing mechanism of a gun to maintain that mechanism in optimum operative condition.

BACKGROUND OF THE INVENTION

In my prior U.S. Pat. No. 4,113,633, I have disclosed a penetrating oil composition which essentially consists of a blend of lower alkyl benzene, lower alkanols, alkyl succinic acid, tert-dibutyl-p-cresol, zinc dialkyl thiophosphate, polymethacrylate and methyl silicone in a paraffin bright stock lube oil base.

The product was a highly successful long-acting penetrating oil which, after penetration, left a liquid film of sufficient tenacity and film strength to protect the lubricated surfaces from rusting.

The product was especially effective where metal structures had rusted to loosen the rust-frozen area and then to protect them against further rusting. Key to this composition was a methyl benzene component which consisted of toluene and xylene, usually in a ratio of about 2.5:1.

Over the years it has been found that the high toluene and xylene levels could not be tolerated by all users and that the composition was capable of improvement, especially for use as a gun oil.

OBJECTS OF THE INVENTION

It is, therefore, the principal object of the present invention to provide an improved gun oil composition which is free from drawbacks of the earlier composition, is more advantageous for use with gun mechanisms, i.e. the mechanisms of revolvers, rifles and automatic weapons, and which has improved penetrating action and lubricating action by comparison with earlier compositions.

It is also an object of the invention to provide an improved method of maintaining the operability of gun mechanisms is in substantially all environments.

SUMMARY OF THE INVENTION

These objects and others which will become apparent hereinafter are attained, in accordance with the invention, with a gun oil composition consisting essentially of:

2.0 to 15% by weight of isopropanol;

20 to 60% by weight of heptane or a petroleum distillate selected from the group which consists of:

solvent refined light paraffinic distillate CAS No. 64741-89-5, solvent refined heavy paraffinic distillate CAS No. 64741-88-4, hydrotreated heavy naphthenic distillate CAS No. 64742-52-5, hydrotreated light naphthenic distillate CAS No. 64742-53-61, solvent dewaxed heavy paraffinic distillate CAS No. 64742-65-0, solvent dewaxed light paraffinic distillate CAS No, 64742-56-9, hydrotreated lubricating oil CAS No. 72623-83-7, solvent refined heavy naphthenic distillate CAS No. 64741-96-4, and hydrotreated heavy paraffinic distillate CAS No. 64742-54-7;

3 to 20% by weight of a mixture of viscosity modifiers, antioxidants and reducing agents including benzyl acetate, t-butylcresol, at least one alkyl succinic acid, at least one zinc alkyl thiophosphate, polymethacrylate, and methyl silicone polymer, wherein the alkyl is $C_1$ to $C_6$ alkyl; and the balance, lube oil bright stock to 100% by weight.

Preferably the mixture in this composition of viscosity modifiers, antioxidents and reducing agents comprises:

benzyl acetate, t-dibutyl-p-cresol, alkylsuccinic acid, zinc alkyl thiophosphate, polymethacrylate, and methyl silicone polymer in a weight ratio of substantially: 1.2:0.8:0.4:1.0:1.9:1.0.

The mixture is present preferably in the composition in a percent by weight of substantially 6.3 but can be present in an amount as small as 3.1 percent by weight to 18.9 percent by weight in an advantageous aspect of the invention. The isopropanol should be present in an amount between 2.1 and 12.5 weight percent and more preferably between 2.1 and 10.0 weight percent. The preferred hydrocarbon is heptane although certain petroleum distillates can be used as described above with their Chemical Abstract Service (CAS) numbers.

The composition is used as a conventional gun oil for lubricating gun mechanisms and may be applied to all of the metal surfaces of a gun to form a protective and lubricating film thereon, to loosen parts which have rusted or otherwise seized and to enable rust to be wiped away from the weapon.

SPECIFIC EXAMPLE

The compositions of the following table are made:

| | Example | | | | | | | |
|---|---|---|---|---|---|---|---|---|
| | 1 | 2 | 3 | 4 | 5 | 6 | 7 | 8 |
| Isopropanol | 10.0 | 2.1 | 3.7 | 4.3 | 5.5 | 7.0 | 8.2 | 12.5 |
| Heptane | 30.0 | 26.5 | 40.0 | 35.0 | 20.0 | 23.4 | 28.8 | |
| Benzyl acetate | 1.5 | 1.2 | 1.2 | 2.4 | 3.6 | 1.2 | 0.6 | 1.2 |
| t-dibutyl-p-cresol | 1.0 | 0.8 | 0.8 | 1.6 | 2.4 | 0.8 | 0.4 | 0.8 |
| Alkylsuccinic acid | 0.6 | 0.4 | 0.4 | 0.8 | 1.2 | 0.4 | 0.2 | 0.4 |
| Zinc dialkyl thiophosphate | 1.4 | 1.0 | 1.0 | 2.0 | 3.0 | 1.0 | 0.5 | 1.0 |
| Polymethacrylate | 2.2 | 1.9 | 1.9 | 3.8 | 5.7 | 1.9 | 0.9 | 1.9 |
| Methyl silicone polymer | 1.4 | 1.0 | 1.0 | 2.0 | 3.0 | 1.0 | 0.5 | 1.0 |

-continued

| | Example | | | | | | | |
|---|---|---|---|---|---|---|---|---|
| | 1 | 2 | 3 | 4 | 5 | 6 | 7 | 8 |
| Lube oil bright stock (to 100%) | 51.9 | 65.1 | 50.0 | 48.1 | 55.6 | 63.3 | 59.9 | 31.2 |
| Petroleum Distillate (and/or heptane) | | | | | | | | 50.0 |

The compositions are formed by mixing and can be applied to the gun as a conventional gun oil.

I claim:

1. A gun oil composition consisting essentially of:

| | |
|---|---|
| isopropanol | 3.7% |
| Heptane | 40.0 |
| Benzyl acetate | 1.2 |
| t-dibutyl-p-cresol | 0.8 |
| Alkylsuccinic acid | 0.4 |
| Zinc dialkyl thiophosphate | 1.0 |
| Polymethacrylate | 1.9; and |
| Methyl Silicone Polymer | 1.0, balance lube oil bright |
| stock to 100%. | |

2. A method of maintaining a gun having metal parts including a firing mechanism, comprising the step of applying to said metal parts a gun oil composition consisting essentially of:

| | |
|---|---|
| isopropanol | 3.7% |
| Heptane | 40.0 |
| Benzyl acetate | 1.2 |
| t-dibutyl-p-cresol | 0.8 |
| Alkylsuccinic acid | 0.4 |
| Zinc dialkyl thiophosphate | 1.0 |
| Polymethacrylate | 1.9; and |
| Methyl Silicone Polymer | 1.0, balance lube oil bright |
| stock to 100%. | |

* * * * *